US005420560A

United States Patent [19]

Hanada

[11] Patent Number: 5,420,560

[45] Date of Patent: May 30, 1995

[54] FUSE

[75] Inventor: Toshiyuki Hanada, Kawaguchi, Japan

[73] Assignee: Daito Communication Apparatus Co., Ltd., Tokyo, Japan

[21] Appl. No.: 135,064

[22] Filed: Oct. 12, 1993

Related U.S. Application Data

[63] Continuation-in-part of Ser. No. 915,343, Jul. 17, 1992, abandoned.

[30] Foreign Application Priority Data

Jul. 29, 1991 [JP] Japan ..... 3-188796

[51] Int. Cl.[6] ..... H01H 85/38

[52] U.S. Cl. ..... 337/273; 337/276

[58] Field of Search ..... 335/273, 276, 280, 282, 335/186

[56] References Cited

U.S. PATENT DOCUMENTS 3,179,853 4/1965 Kozacka ..... 337/186
3,840,836 10/1974 Link ..... 337/276
4,563,666 1/1986 Borzoni ..... 337/186
4,709,222 11/1987 Morita et al. .
4,757,296 7/1988 Brown et al. ..... 337/276

FOREIGN PATENT DOCUMENTS 0300654 7/1988 European Pat. Off. .
1203861 5/1968 United Kingdom .
WO8700964 2/1987 WIPO .

*Primary Examiner*—Lincoln Donovan
*Attorney, Agent, or Firm*—Vineet Kohli; Thomas R. Morrison

[57] ABSTRACT

An improved compact fuse has a fusible metal wire stretched between a pair of metal terminals. The wire and the portion of the terminals to which the wire is connected are enclosed in an envelope made of insulation material. The ends of the terminals protrude outside the envelope. The envelope is filled with silicon cellular resin to cover the wire and create many sectioned spaces that dissipate the thermal energy generated when the wire melts from overcurrent, thereby preventing damage to the envelope. When heated by vaporization of the fusible metal wire, the silicon cellular resin generates byproducts which rapidly extinguish the arc.

17 Claims, 4 Drawing Sheets

FUSE

This is a continuation in part application of application Ser. No. 07/915,343, filed Jul. 17, 1992 now abandoned.

BACKGROUND OF THE INVENTION

The present invention relates to a fuse used to protect electronic parts and equipment from an overcurrent.

A fuse generally performs its function of protecting circuit components from overcurrent by breaking the circuit when a fuse element, generally a metal wire, is heated by Joule heat to its melting point.

When the fuse element melts, the metal vaporizes, causing the pressure within an envelope containing the fuse element, to increase. This increase in internal pressure can substantially damage the fuse.

The protecting role of a fuse is completed when the smallest part at the center of the fusible wire, the part where heat dissipation is most intense, melts. However, the current that flows into the metal wire is large. Thus the entire wire melts, often vaporizing instantly.

Hence fusion caused by the overcurrent instantly generates a large amount of thermal energy, thereby increasing the pressure within the envelope containing the fuse element. Such an increase in internal pressure places a mechanical load on the envelope. In the worst case, the increase in internal pressure causes damage to or breakage of the envelope containing the fuse element.

To ensure reliable functioning, some conventional fuses provide extra space within the envelope containing the fuse element and position terminals connected to the fuse element outside the envelope. The dimensions of the extra space are chosen in relation to the amount of metal in the fuse element.

The increasing miniaturization of electronic circuitry makes strong demands for compact fuses. It is difficult to make a compact fuse with the configuration just described, which ensures the circuit-breaking function of a fuse and prevents damage to the envelope containing the fuse element merely by providing extra space therein.

To overcome this problem, prior art fuses have covered the fusible metal wires with flexible synthetic resin, thereby substituting the resin for the extra space. Such a fuse is disclosed, for example, in Japanese Utility Model Publication No. 38988/1983. However, covering fusible metal wires with flexible synthetic resin presents a problem. Such a configuration cannot ensure sufficient circuit-breaking function while simultaneously resisting mechanical load from the envelope containing the fuse element.

OBJECTS AND SUMMARY OF THE INVENTION

An object of the present invention is to provide a compact fuse that overcomes the drawbacks of the prior art.

A further object of the present invention is to provide a compact fuse capable of reliably dissipating thermal energy generated by overcurrent.

A further object of the present invention is to provide a compact fuse capable of reliably dissipating thermal energy generated by overcurrent before it damages the envelope containing the fuse element.

It is a still further object of the present invention to provide a compact fuse that utilizes the space in the envelope containing the fuse element more effectively than the prior art, thereby improving the circuit-breaking function of the fuse.

Briefly stated, the present invention provides an improved compact fuse which has a fusible metal wire stretched between a pair of metal terminals. The wire and the portion of the terminals to which the wire is connected are enclosed in an envelope made of insulating material. The ends of the terminals protrude outside the envelope. The envelope is then filled with silicone cellular resin which covers the fusible wire, and creates many sectioned spaces that dissipate the thermal energy generated when the wire melts from overcurrent, thereby preventing damage to the envelope.

According to an embodiment of the present invention, there is provided a compact fuse comprising means for breaking an electric circuit in response to overcurrent; means for connecting said means for breaking to said electric circuit; envelope means enclosing said means for breaking and defining a substantially closed space therebetween; said substantially closed space being substantially filled with silicon cellular resin; and said silicon cellular resin being effective for extinguishing an arc caused by overcurrent.

Generally, when the fusible wire of a fuse melts, it generates a large amount of thermal energy. This in turn increases the pressure within the fuse envelope. Such an increase in internal pressure places a mechanical load on the fuse envelope. This can substantially damage the fuse.

Silicon cellular resin is composed of many cells, thus giving it low thermal conductivity. The low thermal conductivity is missing from prior art materials.

When a fusible metal wire is covered with silicon cellular resin, the silicon cellular resin creates many sectioned sub-spaces, which dissipate the thermal energy generated when the wire melts from overcurrent. Thus, covering the fusible metal wire with silicon cellular resin, improves the circuit breaking capacity of the fuse while simultaneously reducing the mechanical load applied to the envelope at the time of fusing. This prevents the fuse body from damage.

Additionally, the arc which forms at the time of fusion is extinguished by silicon cellular resin. Upon melting, the silicon cellular resin produces $SiO_2$ which imparts arc-extinguishing properties to the silicon cellular resin. This feature is missing from prior art fuses which use plastic foams, such as polyurethane, to cover the fusible metal wire.

It is preferred that the silicone cellular resin be in a liquid form at the time it is poured into the envelope, and then allowed to solidify after it fills the envelope. This aids in the formation of sectioned sub-spaces closely attached to the fuse elements, which dissipate the thermal energy inside the fuse body.

In order to reduce the resistance across the terminals, it is preferred that the fuse wire be thick. However, a thick fusible wire requires a large current in order to melt. This in turn generates a very large amount of thermal energy, thereby increasing the pressure within the fuse body. Further, a coating on the outside of the fusible wire further increases the thermal energy inside the fuse body (envelope), thus creating an environment that can substantially damage the fuse.

In order to accomplish this goal, to wit: provide a substantially compact fuse with a thick fusible wire while reducing the mechanical load on the fuse envelope, the present invention provides for the use of a silicon cellular resin which covers the fusible metal wire. Essentially, the superior insulating property of the silicon cellular resin in conjunction with the sectioned sub-spaces, reduces the thermal energy within the fuse body, thereby preventing damage to the fuse.

Prior art fuses that utilize plastic foam to envelope the fusible metal wire, such as polyurethane, are not as effective as the silicon cellular resin of the present invention. An important drawback to using polyurethane is that it lacks the arc-extinguishing properties of the silicon cellular resin. An additional drawback to using polyurethane, is that it is not effective in dissipating the thermal energy which results from the fusion of the fuse wire.

Additionally, the use of such prior art foams requires that the fuse body be bulky, in order to house the foam. This feature alone increases the cost of producing fuses.

It is worth noting that prior art non-cellular resins are very poor conductors of heat. Thus, their use in prior art fuses increases the thermal energy within the fuse body, which can damage the fuse. In an attempt to overcome this drawback, prior art fuse wires have been made thick. However, these thick fuse wires require a larger current in order to melt the fuse wire. This, in turn increases the thermal energy generated inside the bulky fuse body, which results in an increase in the mechanical load applied to the fuse body. These drawbacks effecting prior art fuses can be overcome by the use of silicon cellular resin.

According to a feature of the invention, a fuse comprises: a metal wire effective for breaking an electric circuit in response to an overcurrent; a pair of metal terminals; said metal wire being stretched between said pair of metal terminals; an envelope; said envelope enclosing said metal wire and an effective portion of said metal terminals; and said metal wire being covered by silicon cellular resin.

According to another feature of the invention, a fuse comprises: means for breaking an electric circuit in response to overcurrent; means for connecting the means for breaking to the electric circuit; first envelope means enclosing the means for breaking; second envelope means enclosing the first envelope means; and the first and second envelope means further enclosing an effective portion of the means for connecting.

According to a further embodiment, the fuse of the present invention has a second space formed inside the envelope containing the fuse element. The second space is made by enclosing the fusible metal wire contained in the envelope with a box-shaped enclosure frame. Even if the enclosure frame is cracked or broken by the increase of pressure that results from fusion of the fuse element, thermal energy, which may otherwise damage the envelope, is consumed, thereby reducing the applied load.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 2(*b*) is an exploded side view of a fuse according to the embodiment of the present invention shown in FIG. 1.

DETAILED DESCRIPTION OF THE PREFERRED EMBODIMENT

Figure 1:
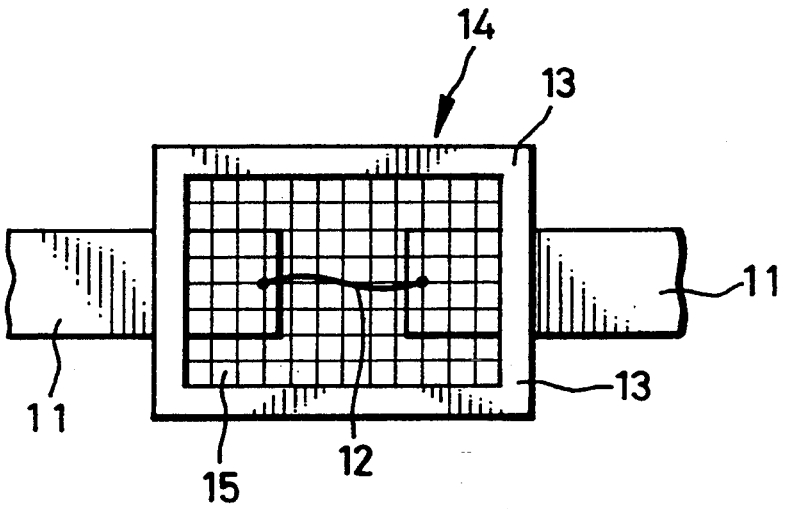
FIG. 1 illustrates the operation of a fuse according to a first embodiment of the present invention.

Referring to FIG. 1, a fuse 14 has a fusible metal wire 12 stretched between a pair of metal terminals 11, 11. Wire 12 and portions of metal terminals 11, 11 are contained in an envelope 13. The ends of terminals 11, 11 protrude from envelope 13. Silicon cellular resin 15 fills envelope 13 and thus covers wire 12 and the portions of terminals 11, 11 inside envelope 13. When an overcurrent passes through a circuit of which fuse 14 is an element, wire 12 is heated to melting, thereby breaking the circuit.

Figures 2A, 2B:
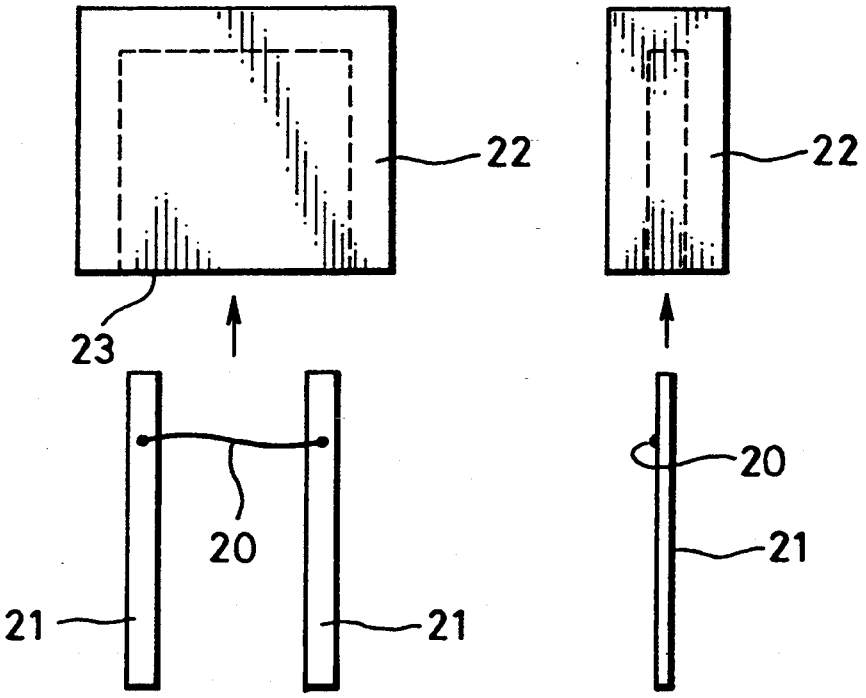
FIG. 2(*a*) is an exploded front view of a fuse according to the embodiment of the present invention shown in FIG. 1.

Referring to FIGS. 2(*a*), 2(*b*), and 3, a fusible metal wire 20 is stretched between a pair of metal terminals 21, 21. Wire 20 and portions of metal terminals 21, 21 are contained in an envelope 22 made of insulating material, such as, for example, polyether sulfone. The ends of terminals 21, 21 protrude from opening 23 of envelope 22 silicon cellular resin 24, such as, for example, KE521 (A.B) manufactured by Shinetsu Chemical Co., Ltd., is poured from opening 23 into envelope 22 to cover wire 20 and the portions of terminals 21, 21 inside envelope 22.

After envelope 22 is filled with silicon cellular resin 24, opening 23 may be covered by lid 25, which may be formed from polybutylene terephthalate.

As the space surrounding wire 20 is filled with silicon cellular resin 24, many sectioned spaces are formed around wire 20 by silicon cellular resin 24. When wire 20 melts, the pressure in the sectioned spaces increases, dissipating thermal energy. Therefore, even if part of the material forming the sectioned spaces is damaged, any energy sufficient to damage envelope 22 is dissipated, thereby reducing the mechanical load applied to envelope 22. Thus reliable circuit-breaking is ensured without the possibility of damage to envelope 22.

Figure 4:
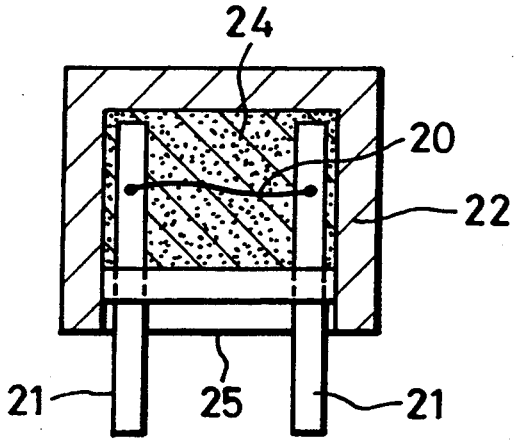
FIG. 4 is a vertical sectional view of with a lid of a fuse according to the embodiment of the present invention shown in FIG. 1.
Figure 5:
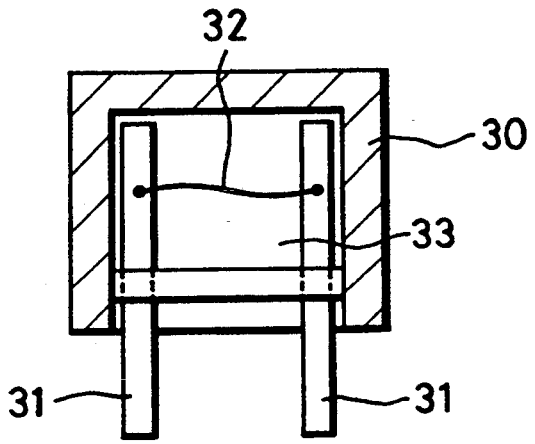
FIG. 5 is a vertical sectional view of a prior art fuse.
Figure 6:
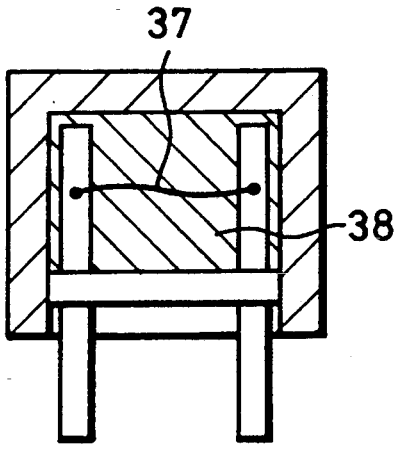
FIG. 6 is a vertical sectional view of another prior art fuse.

Referring to FIGS. 4–6, tests were carried out on samples representing an embodiment of the present invention to compare their efficacy with conventional fuses.

Figure 3:
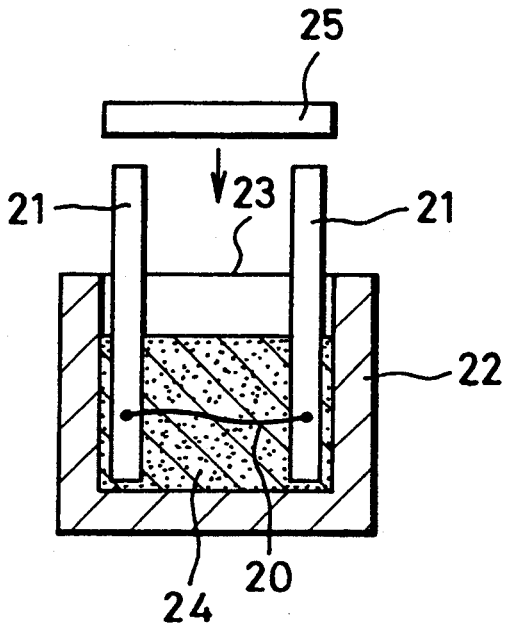
FIG. 3 is a vertical sectional view without a lid of a fuse according to the embodiment of the present invention shown in FIG. 1.

Sample A had the configuration of the embodiment of the present invention shown in FIG. 4, whose description is the same as that in FIGS. 2 and 3 and is therefore omitted here.

Sample B had the conventional configuration shown in FIG. 5. A fusible metal wire 32 connected to metal terminals 31 at both ends is contained in an envelope 30. A space 33 is provided around wire 32.

Sample C had the conventional configuration shown in FIG. 6. A fusible metal wire 37 connected to metal terminals 36 at both ends is contained in envelope 35. Wire 37 is covered with a flexible resin 38 (Silicon Varnish KR-2038 manufactured by Shinetsu Chemical Co., Ltd.).

In sample D, a conventional polyurethane cellular resin such as polymethylene polyphenyl polyisocyanate prepolymer (a/k/a HI SPAN FORM manufactured by Cemedine Co, Ltd.) is used in the same configuration as Sample A except that the silicon cellular resin of the present invention is replaced by the conventional resin as above.

A circuit-breaker test was conducted by running a 50 A current at 130 V DC at 1.3 mmsecond (wherein mm is a unit of length) through five examples each of Samples A, B, and C. The results of the test are shown in Table 1 below. The time of arc of samples A through D are indicated in table 1.

TABLE 1

| Sample A | Sample B | Sample C | Sample D |
|---|---|---|---|
| 1.13 | Unable to extinguish arc | *1.22 | *Unable to extinguish arc |
| 0.82 | Unable to extinguish arc | 0.97 | *46.3 |
| 0.99 | Unable to extinguish arc | 0.83 | *53.9 |
| 1.14 | Unable to extinguish arc | *0.98 | *Unable to extinguish arc |
| 1.05 | Unable to extinguish arc | *0.92 | 1.0 |

In Table 1 "*" indicates damage to the fuse envelope when the current was broken. Essentially, "*" indicates abnormalities such as cracking and breakage of the envelope.

It is seen that in sample B the circuit is broken and the fuse is unable to extinguish the arc between the, terminals thus damaging the envelope.

In sample C, the envelope was damaged as is indicated by "*".

Similarly, sample D indicates the times when the circuit was broken, thus damaging the envelope.

It is also seen that length of time of the arc in sample D, using a conventional resin, is longer (4 out of 5 times), when compared to Sample A. Additionally, the fuse exhibits a far inferior circuit breaking capacity than the fuse of sample A.

It is worth noting, that, upon heating the conventional organic resin, of sample D, the conventional resin produces carbon, which tends to sustain an arc, and might explain why the arc extinguishing property is inferior to the silicon cellular resin of the present invention. In addition, the organic macromolecule which is present in conventional resins does not impart superior insulating property to the fuse when compared to the silicon cellular resin of the present invention.

All the Sample A fuses successfully broke the current without any problem, thereby confirming the superior performance of fuses according to the present invention. All of the Sample B fuses, which have a space around the metal wires, failed to extinguish an arc between the terminals, which arc damaged their envelopes.

Three out of the five Sample C fuses, whose metal wires are covered with flexible resin, presented abnormalities such as cracks and breakage of their envelopes.

Although the present embodiment has a configuration in which a fusible metal wire is covered by a silicon cellular resin, a combination of a silicon cellular resin and a flexible resin may be used instead. Improving the circuit-breaking function of a fuse without damaging its envelope is also possible by means of a silicon cellular resin in which a filler, such as an arc-extinguishing agent, is dispersed.

Furthermore, the method of the present invention is not limited to the above embodiment where a silicon cellular resin is poured into a box-shaped envelope. Fusible metal wires may be covered with silicon cellular resin by casting, or envelopes may be produced by casting or by transfer molding under low pressure.

By covering fusible metal wires with silicon cellular resin, the present invention makes it possible to improve the circuit-breaking function of fuses with a simple structure, while preventing cracks or breakages of envelopes when the pressure inside the envelopes increases as a result of melting or vaporization of the metal wires.

Figure 7:
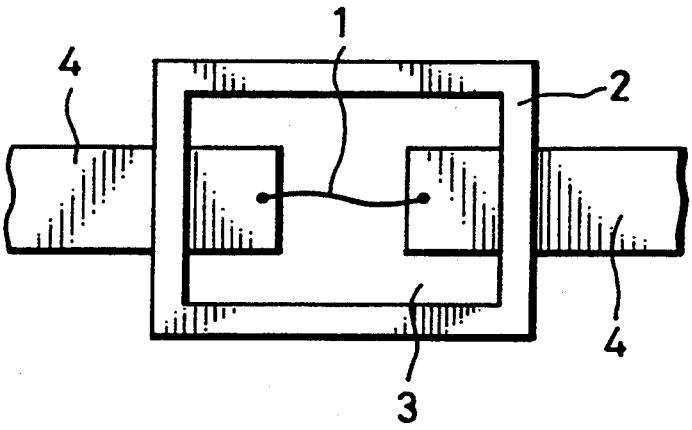
FIG. 7 illustrates how a prior art fuse works.

Referring to FIG. 7, in order to ensure reliable breaker function, some conventional fuses provide an envelope 2 with a space 3 therein, the dimension of space 3 being determined with respect to the amount of metal used in a metal wire 1 that serves as the fuse element. A pair of terminals 4, 4 connected to both ends of wire 1 are placed with as much of their body as possible out of envelope 2.

Figure 8:
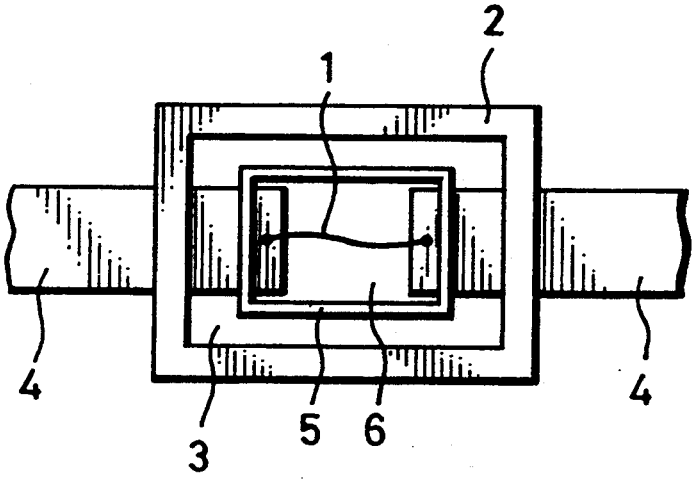
FIG. 8 illustrates a fuse according to a second embodiment of the present invention.

Referring to FIG. 8, in a second embodiment of the present invention, a second space 6 is formed inside envelope 2 by enclosing wire 1 within envelope 2 in a box-shaped enclosure frame 5. Even if frame 5 is cracked or broken by the increase of pressure in second space 6 when wire 1 fuses, enough thermal energy that might otherwise damage envelope 2 is dissipated to reduce the load applied to envelope 2 below the damage point.

Having described preferred embodiments of the invention with reference to the accompanying drawings, it is to be understood that the invention is not limited to those precise embodiments, and that various changes and :modifications may be effected therein by one skilled in the art without departing from the scope or spirit of the invention as defined in the appended claims.

What is claimed is:

1. A fuse, comprising:

means for breaking an electric circuit in response to an overcurrent;

envelope means enclosing said means for breaking and defining a substantially closed space therebetween;

a silicon cellular resin substantially filling said substantially closed space;

said silicon cellular resin including a plurality of sectioned sub-spaces effective for dissipating thermal energy; and said silicon cellular resin being effective for extinguishing an arc caused by said overcurrent.

2. A fuse as in claim 1, further comprising at least one flexible resin.

3. A fuse as in claim 1, wherein said means for breaking is a metal wire.

4. A fuse as in claim 3, wherein said cellular resin is a flexible plastic resin.

5. A fuse as in claim 1, wherein said envelope means includes insulating material.

6. A fuse, comprising:

a metal wire effective for breaking an electric circuit in response to an overcurrent;

a pair of metal terminals;

said metal wire extending between said pair of metal terminals;

an envelope;

a silicon cellular resin in said envelope;

said silicon cellular resin covering said metal wire;

said envelope forming a substantially enclosed space between itself and said silicon cellular resin;

said silicon cellular resin including a plurality of sectioned sub-spaces effective for dissipating thermal energy; and said silicon cellular resin substantially filling said substantially closed space.

7. A fuse, which comprises:

means for breaking an electric circuit in response to an overcurrent;

first envelope means enclosing said means for breaking and defining a first substantially closed space therebetween; and second envelope means enclosing said first envelope means and defining a second substantially closed space therebetween.

8. A fuse as in claim 7, wherein said means for breaking is a metal wire.

9. A fuse as in claim 7, wherein said first and said second envelope means are of insulating material.

10. A fuse according to claim 7, wherein:

said means for dividing includes at least a second envelope within said substantially closed space;

said second envelope forming a second substantially closed space between itself and said metal wire; and said second envelope further forming a third substantially closed space between itself and the first-mentioned envelope.

11. A fuse, comprising:

a metal wire;

said metal wire being fusible at a high current therethrough for breaking an electric circuit;

an envelope enclosing said metal wire;

said envelope defining a substantially closed space between itself and said metal wire;

means for dividing said substantially closed space into at least three substantially closed sub-spaces, whereby products generated by fusing said metal wire remain inside said envelope by entrapment within said sub-spaces; and said means for dividing including silicon cellular resin at least on said metal wire; wherein said silicon cellular resin includes a plurality of sectioned sub-spaces effective for dissipating thermal energy.

12. A fuse according to claim 11, wherein:

said means for dividing includes a silicon cellular resin substantially filling said substantially closed space.

13. A fuse according to claim 1, wherein said silicon cellular resin is capable of generating $SiO_2$.

14. A fuse according to claim 6, wherein said silicon cellular resin is capable of generating $SiO_2$.

15. A fuse according to claim 9, wherein said insulating material includes a silicon cellular resin.

16. A fuse according to claim 16, wherein said silicon cellular resin is capable of generating $SiO_2$.

17. A fuse according to claim 1, wherein said silicon cellular resin covers said means for breaking an electric circuit in response to an overcurrent.

* * * * *